US006945331B2

(12) United States Patent
Patel

(10) Patent No.: US 6,945,331 B2
(45) Date of Patent: Sep. 20, 2005

(54) MULTIPLE INTERVENTIONLESS ACTUATED DOWNHOLE VALVE AND METHOD

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 169 days.

(21) Appl. No.: 10/632,198

(22) Filed: Jul. 31, 2003

(65) Prior Publication Data

US 2004/0020657 A1 Feb. 5, 2004

Related U.S. Application Data

(60) Provisional application No. 60/399,987, filed on Jul. 31, 2002.

(51) Int. Cl.[7] ..... E21B 34/10

(52) U.S. Cl. ..... 166/386; 166/264; 166/317; 166/376

(58) Field of Search ..... 166/264, 317, 166/319, 386, 336, 321, 250

(56) References Cited

U.S. PATENT DOCUMENTS

| | | | | |
|---|---|---|---|---|
| 3,858,650 A | | 1/1975 | Mott | |
| 4,474,242 A | * | 10/1984 | Upchurch | 166/323 |
| 4,603,742 A | * | 8/1986 | Wong et al. | 166/374 |
| 4,979,569 A | | 12/1990 | Anyan et al. | |
| 5,238,070 A | * | 8/1993 | Schultz et al. | 166/386 |
| 5,447,201 A | | 9/1995 | Mohn | |
| 5,531,270 A | | 7/1996 | Fletcher et al. | |
| 5,810,087 A | | 9/1998 | Patel | |
| 5,950,733 A | | 9/1999 | Patel | |
| 5,992,520 A | * | 11/1999 | Schultz et al. | 166/264 |
| 6,041,864 A | | 3/2000 | Patel et al. | |
| 6,073,698 A | * | 6/2000 | Schultz et al. | 166/317 |
| 6,085,845 A | | 7/2000 | Patel et al. | |
| 6,230,807 B1 | | 5/2001 | Patel | |
| 6,250,383 B1 | | 6/2001 | Patel | |
| 6,328,109 B1 | | 12/2001 | Pringle et al. | |
| 6,352,119 B1 | | 3/2002 | Patel | |
| 6,401,826 B2 | | 6/2002 | Patel | |
| 6,516,886 B2 | | 2/2003 | Patel | |
| 6,550,541 B2 | | 4/2003 | Patel | |

FOREIGN PATENT DOCUMENTS

| | | |
|---|---|---|
| EP | 0811747 | 12/1997 |
| GB | 2290319 | 12/1995 |
| GB | 2359836 | 9/2001 |
| WO | WO 97/41333 | 11/1997 |
| WO | WO 99/47789 | 9/1999 |

OTHER PUBLICATIONS

"Formation Isolation Valve", Schlumberger catalog—QUANTUM Sand Control Acessories, p. 43.

* cited by examiner

*Primary Examiner*—Frank Tsay
(74) *Attorney, Agent, or Firm*—Bryan P. Galloway; Kevin P. McEnaney; Jaime A. Castaño

(57) ABSTRACT

The multiple interventionless actuated downhole valve includes a valve movable between an open and a closed position to control communication between an annular region surrounding the valve and an internal bore and more specifically controlling communication between above and below the valve, and at least two remotely operated interventionless actuators in operational connection with the valve, wherein each of the interventionless actuators may be operated independently by absolute tubing pressure, absolute annulus pressure, differential pressure from the tubing to the annulus, differential pressure between the annulus and the tubing, tubing or annulus multiple pressure cycles, pressure pulses, acoustic telemetry, electromagnetic telemetry or other types of wireless telemetry to change the position of the valve and allowing the valve to be continually operated by mechanical apparatus.

25 Claims, 5 Drawing Sheets

MULTIPLE INTERVENTIONLESS ACTUATED DOWNHOLE VALVE AND METHOD

RELATED APPLICATIONS

This application claims the benefit of priority under 35 U.S.C. §119 of U.S. Provisional Application Ser. No. 60/399,987, filed 31 Jul. 2001 and entitled ACTUATOR AND METHOD, which is incorporated by reference herein.

FIELD OF THE INVENTION

The present invention relates in general to actuation of valves and isolation of sections of a borehole and more specifically to an apparatus and method for actuating a downhole valve more than once without physical intervention.

BACKGROUND

In drilling operations it is common practice to include one or more valves connected within a pipe string to separate and control the flow of fluid between various sections of the wellbore. These valves are commonly referred to as formation isolation valves (FIV). The formation isolation valve can be constructed in numerous manners including, but not limited to, ball valves, discs, flappers and sleeves. These valves are primarily operated between an open and closed position through physical intervention, i.e. running a tool through the valve to open. To close the valve the tool string and a shifting tool are withdrawn through the formation isolation valve. The shifting tool engages a valve operator that is coupled to the valve moving the valve between the open and closed position.

It is often desired to open the FIV without physical intervention after the valve has been closed by physical intervention, such as by running a shifting tool through the FIV via a wireline, slickline, coil tubing or other tool string. Therefore, it has been shown to provide an interventionless apparatus and method for opening the FIV a single time remotely from the surface. Interventionless is defined to include apparatus and methods of actuating a downhole valve without the running of physical equipment through and/or to the operational valve. Apparatus and methods of interventionlessly operating a downhole valve a single time are described and claimed by the commonly owned United States Patents to Dinesh Patel. These patents include, U.S. Pat. Nos. 6,550,541; 6,516,886; 6,352,119; 6,041,864; 6,085,845, 6,230,807, 5,950,733; and 5,810,087, each of which is incorporated herein by reference.

Some well operations require multiple interventionless openings of the FIV. For example, opening the FIV after setting a packer, pressure testing of the tubing, perforating, flowing of a well for cleaning, and shutting in a well for a period of time.

Heretofore, there has only been the ability to actuate a FIV remotely and interventionlessly once. Therefore, the interventionless actuator can only be utilized after one operation. Further, if the single interventionless actuator fails it is required to go into the wellbore with a physical intervention to open the FIV. This inflexibility to remotely and interventionlessly open the FIV more than once or upon a failure can be catastrophic. In particular in high pressure, high temperature wells, deep water sites, remote sites and rigless completions wherein intervention with a wireline, slickline, or coiled tubing is cost prohibitive.

It is therefore a desire to provide a multiple, interventionless actuated downhole valve. It is a further desire to provide a multiple, interventionless actuated downhole valve wherein each actuating mechanism operates independently from other included interventionless actuating mechanisms.

SUMMARY OF THE INVENTION

In view of the foregoing and other considerations, the present invention relates to remote interventionless actuating of a downhole valve.

It is a benefit of the present invention to provide a method and apparatus that provides multiple mechanisms for opening a downhole valve without the need for a trip downhole to operate the valve.

It is a further benefit of the present invention to provide redundant mechanisms for interventionlessly opening a downhole valve if initial attempts to interventionlessly open the valve fail.

Accordingly, a interventionless actuated downhole valve and method is provided that permits multiple openings of a downhole valve without the need for a trip downhole to open the valve. The multiple interventionless actuated downhole valve includes a valve movable between an open and a closed position to control communication between an annular region surrounding the valve and an internal bore and more specifically controlling communication between above and below the valve, and at least two remotely operated interventionless actuators in operational connection with the valve, wherein each of the interventionless actuators may be operated independently by absolute tubing pressure, absolute annulus pressure, differential pressure from the tubing to the annulus, differential pressure between the annulus and the tubing, tubing or annulus multiple pressure cycles, pressure pulses, acoustic telemetry, electromagnetic telemetry or other types of wireless telemetry to change the position of the valve and allowing the valve to be continually operated by mechanical apparatus.

The present invention includes at least two interventionless actuators but may include more. Each of the interventionless actuators may be actuated in the same manner or in differing manners. It is desired to ensure that only one interventionless actuator is operated at a time.

In a preferred embodiment increasing pressure within the internal bore above a threshold pressure operates at least one of the interventionless actuators. In another preferred embodiment an interventionless actuator is operated by a differential pressure between the internal bore and the annular region.

It should be recognized that varying types of interventionless actuators may be utilized. Some of the possible interventionless actuators are described in U.S. Pat. Nos. 6,550,541; 6,516,886; 6,352,119; 6,041,864; 6,085,845, 6,230,807, 5,950,733; and 5,810,087, all to Patel, each of which is incorporated herein by reference.

The downhole valve has been described as a ball valve, however, other types of valves may be used, such as but not limited to flappers, sleeves, and discs, holding pressure in one direction or both directions. An example of a flapper valve is disclosed in U.S. Pat. No. 6,328,109 to Patel, and is incorporated herein by reference.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
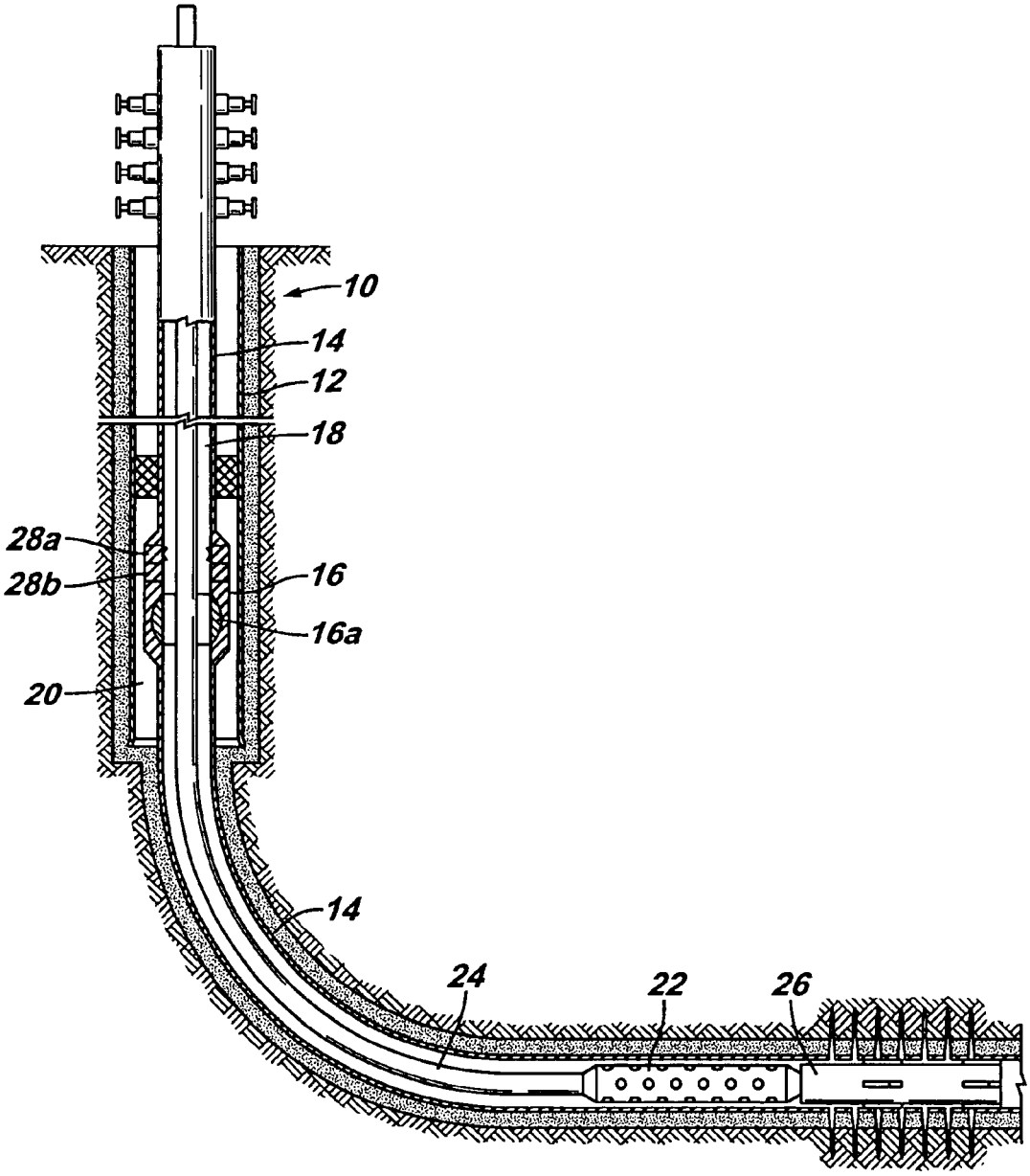
FIG. 1 is an illustration of a wellbore including a downhole valve having multiple, interventionless actuators of the present invention.

Refer now to the drawings wherein depicted elements are not necessarily shown to scale and wherein like or similar elements are designated by the same reference numeral through the several views.

FIG. 1 is an illustration of a wellbore including a downhole valve having multiple interventionless actuators. In FIG. 1 a wellbore 10 having a vertical section and a deviated section is shown. Casing 12 is cemented within at least a portion of wellbore 10. A production string 14 carrying a downhole valve 16, shown as a formation isolation valve (FIV), is positioned within wellbore 10. In one embodiment, FIV 16 includes a ball valve 16*a*. Production string 14 and FIV 16 include an internal bore 18. An annulus 20 is formed outside of FIV 16 that is subject to a pressure outside of the bore 18.

A tool 22, such as a perforating gun, may be run on a tool string 24, such as coiled tubing, through bore 18 of string 14 and FIV 16. As and example a shifting tool 26 is connected to a bottom end of tool string 24. Shifting tool 26 may be utilized singular or in combination with other tools 22, such as in a sand control application the FIV may be run in the lower completion below or above a screen hanger packer. Shifting tool 26 may be used repeatedly to open and close valve 16*a* by running shifting tool 26 through FIV 16. This is a physical, or intervention actuation of valve 16*a*.

FIV 16 may be actuated from the closed position to an open position by more than one interventionless actuator 28. Interventionless actuators 28 allow an operator to open valve 16*a* without running into wellbore 10 with a shifting tool 26, thus saving a trip downhole and great expense. As shown in FIG. 1, FIV includes two interventionless actuators 28*a* and 28*b*. Each interventionless actuator 28 is independent of the other interventionless actuator 28. Therefore, it is possible to open FIV 16 more than once without physical intervention. Additionally, multiple interventionless actuators 28 provide redundancy in case an interventionless actuator 28 fails.

Figure 2A:
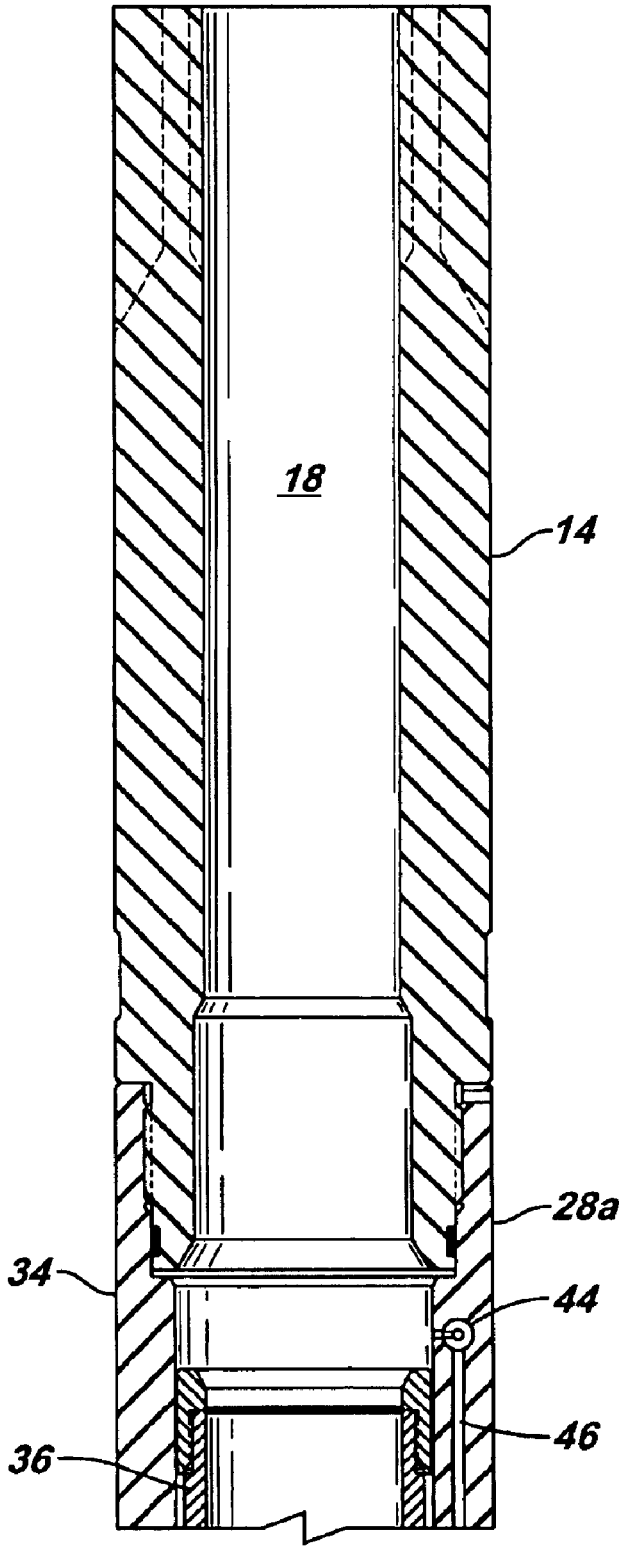
FIGS. 2*a*, 2*b*, 2*c*, and 2*d* show a preferred embodiment of the multiple interventionless actuator downhole valve of the present invention.
Figure 2B:
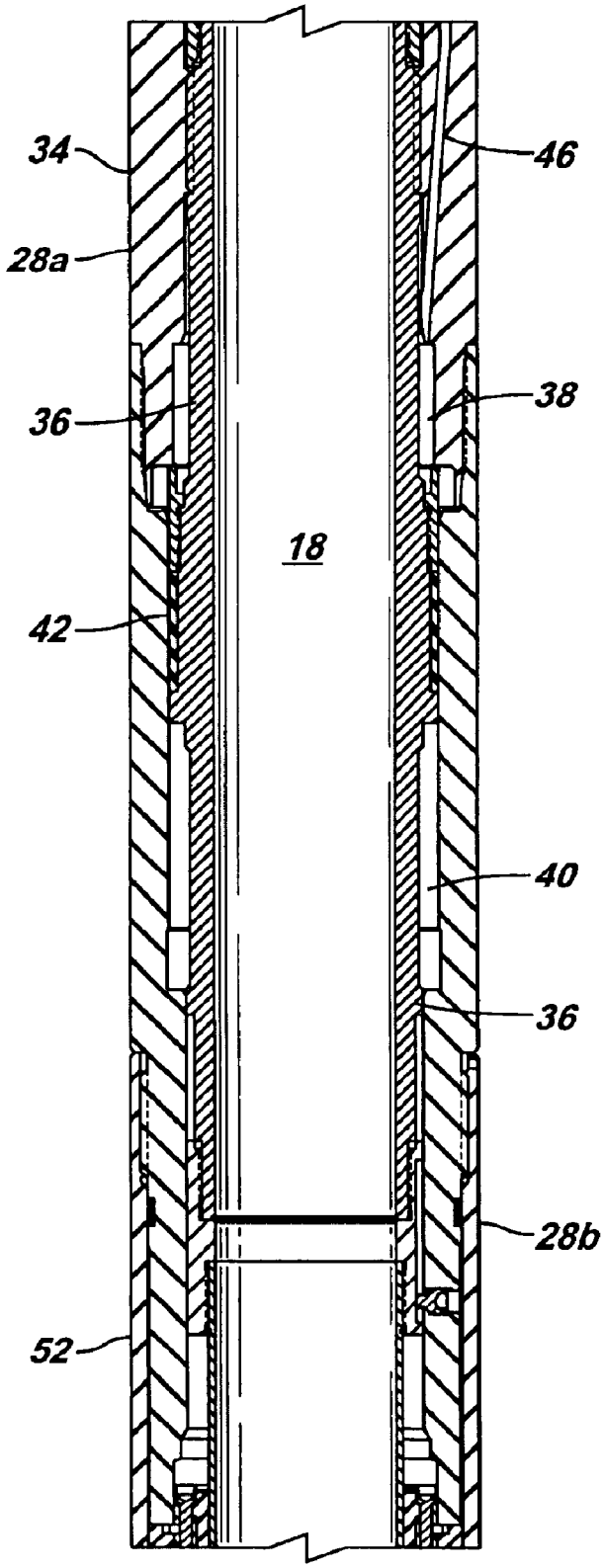
Figure 2C:
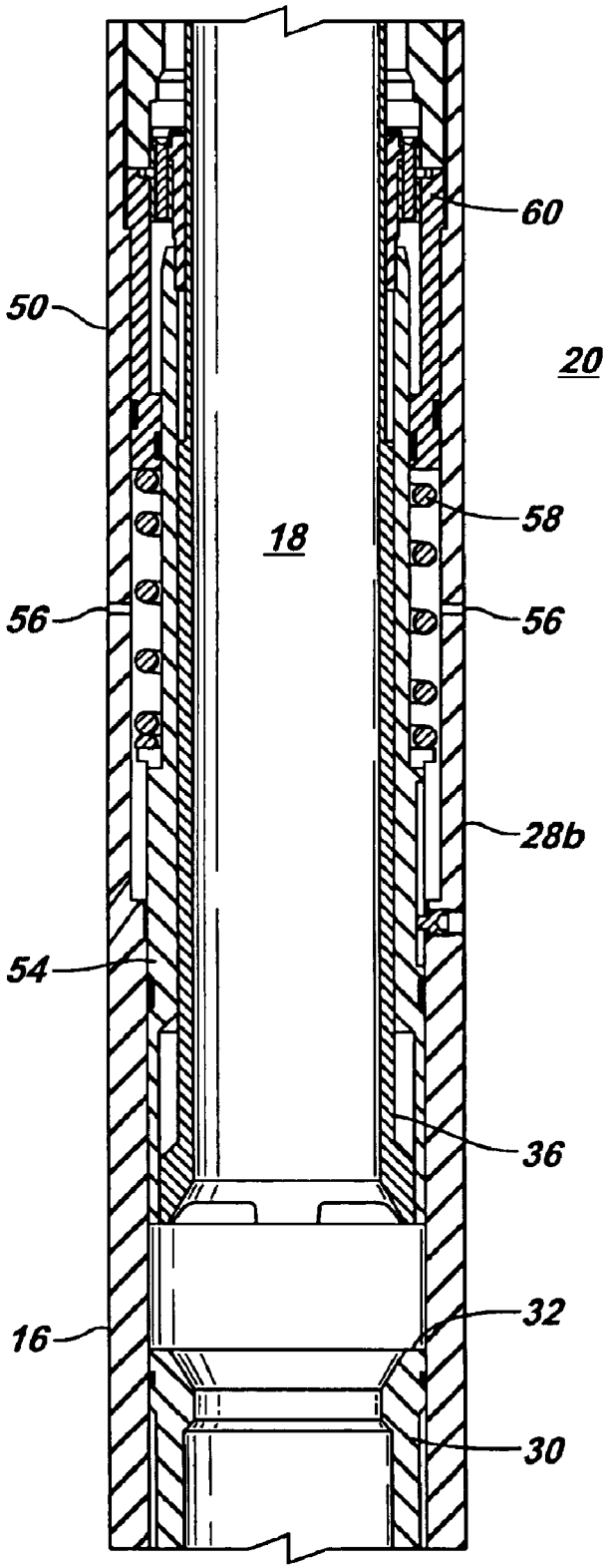
Figure 2D:
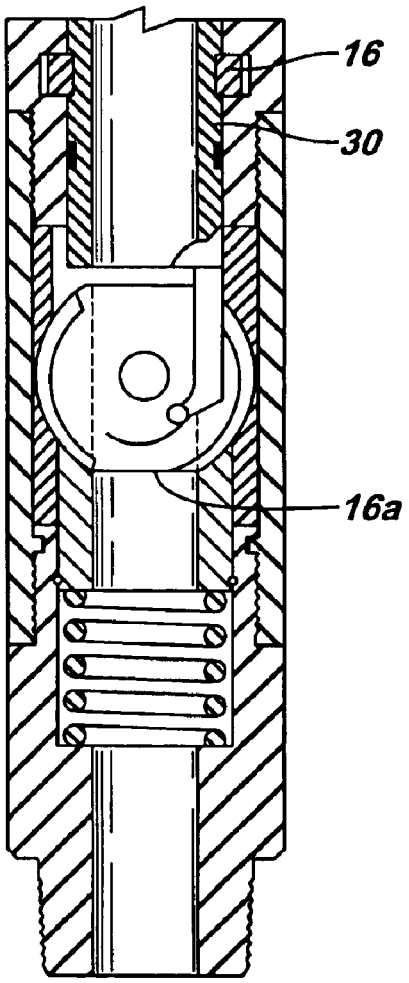

Referring to FIGS. 2*a*, 2*b*, 2*c*, and 2*d*, a preferred embodiment of the multiple interventionless actuator downhole valve of the present invention is shown. FIGS. 2*a* and 2*b* illustrate a first interventionless actuator 28*a*. FIGS. 2*b* and 2*c* illustrate a second interventionless actuator 28*b*. FIGS. 2*c* and 2*d* illustrate a downhole valve 16.

With reference to FIGS. 2*c* and 2*d* downhole formation isolation valve 16 is shown. In a preferred embodiment valve 16 includes a ball valve 16*a* that is movable between an open and closed position. Valve 16 includes an operating mandrel 30 functionally connected to ball valve 16*a* for moving ball valve 16*a* between the open and closed positions. Operating mandrel 30 includes a shoulder 32.

Referring to FIGS. 2*a* and 2*b* a first interventionless actuator 28*a* is shown. Interventionless actuator 28*a* is an absolute pressure actuator having a housing 34 and first actuator power mandrel 36. Actuator 28*a* includes a first atmospheric pressure chamber 38 and a second atmospheric pressure chamber 40 separated by a seal 42. A rupture disc assembly 44 is in communication with bore 18 and first atmospheric pressure chamber 38 via a conduit 46.

Figure 3:
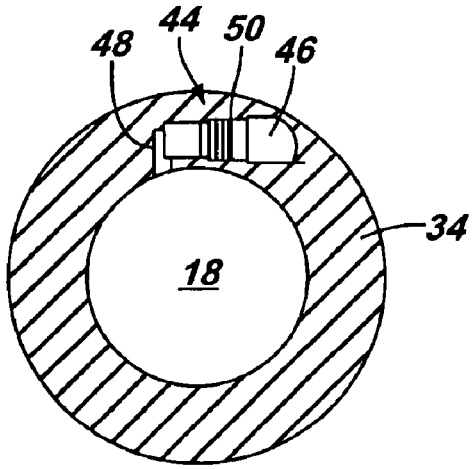
FIG. 3 is an illustration of a rupture disc assembly of the present invention.

Rupture disc assembly 44 is described with reference to FIG. 3. Rupture disc assembly 44 includes a tangential port 48 in communication with inside bore 18 and conduit 46. A rupture disc 50 is positioned between bore 18 and conduit 46. Therefore, when the inside pressure in bore 18 exceeds a predetermined threshold, rupture disc 50 ruptures, permitting fluid communication between bore 18 and conduit 46.

Referring again to FIGS. 2*a*, 2*b*, 2*c*, 2*d*, and 3 operation of first interventionless actuator 28*a* is described. When it is desired to utilize interventionless actuator 28*a* to open valve 16*a* of FIV 16 the pressure is increased in bore 18 overcoming the threshold of rupture disc 50. Rupture disc 50 ruptures increasing the pressure within atmospheric pressure chamber 38 above that of second atmospheric pressure chamber 40 moving first power mandrel 36 downward. First power mandrel 36 contacts shoulder 32 of operating mandrel 30, moving operating mandrel 30 down opening valve 16*a*. The pressure in first and second pressure chambers 38 and 40 equalize and the chambers remain in constant fluid communication allowing valve 16*a* to be opened through mechanical intervention. A method and apparatus of achieving constant fluid communication between first atmospheric chamber 38 and second atmospheric chamber 40 is described in U.S. Pat. No. 6,516,886 to Patel, which is incorporated herein by reference.

Referring to FIGS. 2*b*, 2*c* and 2*d* a second interventionless actuator 28*b* is shown. Interventionless actuator 28*b* is also a pressure operated actuator. Interventionless actuator 28*b* operates based on differential pressure between the inside pressure in bore 18 and an outside pressure in annular region 20, that may be formation pressure. Interventionless actuator 28*b* includes a housing 52, a second actuator power mandrel 54, a port 56 formed through housing 50 in communication with the annulus 20, a spring 58 urges power mandrel 54 downward, and a tension bar 60 holding power mandrel 54 in a set position. Tension bar 60 may be a shear ring or shear screws and our included in the broad definition of a tension bar for the purposes of this description for application as is known in the art.

Interventionless actuator 28*a* is activated by creating a pressure differential between the inside pressure in bore 18 and the outside pressure in annular region 20. One method of operation is to pressure up in bore 18 thus pushing second actuator power mandrel 54 upward until a predetermined pressure is achieved breaking tension bar 60. The inside pressure may then be reduced and spring 58 urges power mandrel 54 downward into functional contact with shoulder 32 of operator mandrel 30 opening valve 16*a*. The differential pressure between the outside and the inside of bore 18 created by bleeding off the inside pressure in bore 18 assists spring 58 to urge second power mandrel 54 down. Once valve 16*a* is cracked open the outside pressure and inside pressure will equalize. Spring 58 continues to urge power mandrel 54 downward. Valve 16*a* may be reclosed utilizing a physical intervention.

Another method of operation includes bleeding inside pressure down in bore 18 creating a lower inside pressure than the outside pressure. Fluid passes through port 56 overcoming the inside pressure and forcing power mandrel 54 downward. When the downward force on power mandrel 54 overcomes the threshold of tension bar 60, tension bar 60 parts allowing power mandrel 54 to move downward, contacting and urging power mandrel 30 downward opening valve 16*a*.

Embodiments of the invention may have one or more of the following advantages. By using multiple interventionless actuators pressure can be utilized to open the valve more than once while avoiding the need for a trip downhole to operate the valve. Multiple interventionless actuators further provide a redundancy whereby, if one interventionless actuator fails another independent interventionless actuator may be utilized. Even after successfully operating an interventionless actuator the valve can be subsequently opened and closed mechanically by a shifting tool.

From the foregoing detailed description of specific embodiments of the invention, it should be apparent that a multiple interventionless actuated downhole valve that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow. For example, various materials of construction may be used, variations in the manner of activating each interventionless actuator, the number of interventionless actuators employed, and the type of interventionless actuators utilized. For example, it may desired to utilize an absolute pressure actuator for each of the interventionless actuators or utilized differing types of interventionless actuators.

What is claimed is:

1. An apparatus usable in a subterranean well, comprising:

a valve movable between an open and a closed position to control communication between an annular region surrounding the valve and an internal bore; and at least two remotely operated interventionless actuators in operational connection with the valve;

wherein each of the interventionless actuators may be operated independently to move the valve between the closed position and open position and further allowing the valve to be actuated by a mechanical apparatus.

2. The apparatus of claim 1, wherein at least one of the interventionless actuators includes:

a first and a second pressure chamber; and a rupture disc located between a pressure source and the first pressure chamber.

3. The apparatus of claim 2, wherein the rupture disc is located between the internal bore and the first pressure chamber.

4. The apparatus of claim 2, wherein the at least one interventionless actuator includes a power mandrel to change the valve position in response to a fluid flow through the rupture disc assembly into the first pressure chamber.

5. The apparatus of claim 3, wherein the at least one interventionless actuator includes a power mandrel to change the valve position in response to a fluid flow through the rupture disc assembly into the first pressure chamber.

6. The apparatus of claim 1, wherein at least one of the interventionless actuators changes the valve position in response to pressure in the internal bore.

7. The apparatus of claim 1, wherein at least one of the interventionless actuators changes the valve position in response to a pressure differential between the internal bore and the annular region.

8. The apparatus of claim 6, wherein at least another one of the interventionless actuators changes the valve position in response to a pressure differential between the internal bore and the annular region.

9. The apparatus of claim 1, wherein at least one of the interventionless actuators includes:

a housing having a port in communication with the annular region;

a power mandrel;

a breakable tension bar in connection between the housing and the power mandrel; and a spring biasing the power mandrel.

10. The apparatus of claim 9, wherein the power mandrel to change the valve position in response to a pressure differential between the internal bore and the annular region.

11. The apparatus of claim 1, wherein at least two the interventionless actuators change the valve position in response to pressure in the internal bore.

12. The apparatus of claim 1, wherein at least two the interventionless actuators change the valve position in response to a pressure differential between the internal bore and the annular region.

13. The apparatus of claim 2, wherein at least another one of the interventionless actuators includes:

a housing having a port in communication with the annular region;

a second actuator power mandrel;

a breakable tension bar in connection between the housing and the second actuator power mandrel; and a spring biasing the second actuator power mandrel.

14. The apparatus of claim 13, wherein the rupture disc is located between the internal bore and the first pressure chamber.

15. The apparatus of claim 14, wherein the at least one interventionless actuator includes a first actuator power mandrel to change the valve position in response to a fluid flow through the rupture disc assembly into the first pressure chamber.

16. The apparatus of claim 13, wherein the second actuator power mandrel to change the valve position in response to a pressure differential between the internal bore and the annular region.

17. The apparatus of claim 15, wherein the second actuator power mandrel to change the valve position in response to a pressure differential between the internal bore and the annular region.

18. An apparatus usable in a subterranean well, comprising:

a means of controlling communication between an annular region surrounding the controlling means and an internal bore, said controlling means moveable between an open position and a closed position; and at least two means for remote interventionless actuation of said controlling means to move said controlling means from one position to another;

wherein each of the interventionless actuation means may be operated independently from other interventionless actuation means to change the position of the controlling means.

19. The apparatus of claim 18, wherein at least one of the interventionless actuating means changes the valve position in response to pressure in the internal bore.

20. The apparatus of claim 18, wherein at least one of the interventionless actuating means changes the valve position in response to a pressure differential between the internal bore and the annular region.

21. The apparatus of claim 18, wherein at least one of the interventionless actuating means changes the valve position in response to a signal received by the interventionless actuating means.

22. A method of interventionless opening of a downhole valve, the method comprising:

positioning a valve movable between an open and a closed position to control communication between an annular region surrounding the valve and an internal bore, the valve in a closed position;

positioning at least two interventionless actuators in operational connection with the valve; and actuating at least one of the interventionless actuators independent of the other interventionless actuators to open the valve.

23. The method of claim 22, wherein the actuating step includes increasing pressure in the internal bore.

24. The method of claim 22, wherein the actuating step is in response to a differential pressure between the internal bore and the annular region.

25. The method of claim 22, wherein the actuating step is in response to a signal received by the interventionless actuating means.

* * * * *